US007912396B2

(12) United States Patent
Park

(10) Patent No.: US 7,912,396 B2
(45) Date of Patent: Mar. 22, 2011

(54) PRINTER AND DUPLEX PRINTING MODE CONTROLLING METHOD THEREOF

(75) Inventor: Young-kook Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 335 days.

(21) Appl. No.: 11/384,384

(22) Filed: Mar. 21, 2006

(65) Prior Publication Data

US 2006/0291890 A1 Dec. 28, 2006

(30) Foreign Application Priority Data

Jun. 27, 2005 (KR) ..... 10-2005-0055916

(51) Int. Cl.
*G03G 15/00* (2006.01)

(52) U.S. Cl. ..... 399/85; 399/43

(58) Field of Classification Search ..... 399/43, 399/82, 85

See application file for complete search history.

(56) References Cited

U.S. PATENT DOCUMENTS

| | | | | |
|---|---|---|---|---|
| 4,924,275 | A * | 5/1990 | Nelson | 399/401 |
| 2004/0190926 | A1* | 9/2004 | Burkes et al. | 399/82 |

FOREIGN PATENT DOCUMENTS

| | | |
|---|---|---|
| JP | 09-231026 | 9/1997 |
| JP | 09-248942 | 9/1997 |
| JP | 09-254471 | 9/1997 |
| JP | 09254471 A * | 9/1997 |
| JP | 10-109447 | 4/1998 |
| JP | 11-355546 | 12/1999 |
| JP | 2002-229391 | 8/2002 |
| JP | 2003-263074 | 9/2003 |
| JP | 2004-12982 | 1/2004 |
| JP | 2005-128715 | 5/2005 |

OTHER PUBLICATIONS

English translation of Misawa JP 09-254471 (cited on Oct. 28, 2009 IDS).*

Office Action issued in Japanese Patent Application No. 2006-166724 on Jul. 28, 2009.

Japanese Office Action for corrresponding Japanese Patent Application No. 2006-166724 dated Jul. 6, 2010 (2 pgs).

* cited by examiner

*Primary Examiner* — David M Gray
*Assistant Examiner* — Joseph S Wong
(74) *Attorney, Agent, or Firm* — Staas & Halsey LLP

(57) ABSTRACT

A printer, including a printing unit to print print data on print medium. The printer includes a memory to temporarily store the print data supplied from a user terminal, a controller to temporarily cancel a duplex printing mode of the printer and to control the printing unit to print the print data in a normal printing mode, when the duplex printing mode is preset and a quantity of the print data temporarily stored in the memory is within a range of predetermined quantities, a printing path along which the print medium is provided to the printing unit so as to have an image printed on a first side thereof, an ejecting path along which the pieces of print media, having had the image printed on the first sides thereof, are ejected from the printer in the normal printing mode, or are partially ejected from the printer in the duplex printing mode, and a reversing path to convey the print medium from the partly ejected position of the ejecting path and toward a beginning of the printing path to position the print medium to be conveyed along the printing path so as to have another image printed on a second side thereof.

15 Claims, 3 Drawing Sheets

PRINTER AND DUPLEX PRINTING MODE CONTROLLING METHOD THEREOF

CROSS-REFERENCE TO RELATED APPLICATIONS

This application claims the benefit of Korean Application No. 2005-55916, filed Jun. 27, 2005, in the Korean Intellectual Property Office, the disclosure of which is incorporated herein by reference.

BACKGROUND OF THE INVENTION

1. Field of the Invention

An aspect of the present invention relates to a printer and a duplex printing mode controlling method thereof, and, more particularly, to a printer that shortens printing time by temporarily canceling a duplex printing mode, which is an operational mode to perform printing on both sides of paper, when an amount of print data requiring one side of one piece of paper is inputted into a printer that is preset in the duplex printing mode, and a duplex printing mode controlling method thereof.

2. Description of the Related Art

Although conventional printers output paper with data printed on one side only, advancing printer technology and user's demands call for development of printers capable of performing printing on both sides, i.e., duplex printing. FIG. 1 is a cross-sectional view showing a conventional laser beam printer having a duplex printing capability. As shown in the drawing, the main body 10 of the laser beam printer having a duplex printing function includes a printing path 9 to print an image on paper, an ejecting path 16 to eject printed paper, and a reversing path 20 to reverse the printed paper for duplex printing.

Herein, a pickup roller 12, a feeding roller 13, and a printing unit 14, 15, 18 and 19 are disposed at the printing path 9. The pickup roller 12 picks up paper in a paper supplying cassette 11, and the feeding roller 13 feeds the paper picked up by the pickup roller 12 into the printing unit 14, 15, 18 and 19. The printing unit 14, 15, 18 and 19 is formed of different constitutional elements according to the kind of a printer. Where a laser beam printer is used, the printing unit is formed of a laser scanner 14, a developer 18, a photosensitive drum 19, and a fixing roller 15.

An ejection roller 17 to eject paper from the apparatus is disposed on the ejecting path 16 at an end thereof. The ejection roller 17 also reverses the driving direction under the control of a controller (not shown) to have the ability to transfer the paper in an ejection direction or toward the beginning of the reversing path 20.

Several pairs of transfer rollers 22 to guide paper to the feeding roller 13 are disposed on the reversing path 20.

The operation of a printer having the above-described structure and the duplex printing capability will now be described. When a duplex printing mode is set up and print data is inputted into the printer by a user terminal, rollers as well as the printing unit 14, 15, 18 and 19 are operated. A sheet of paper is picked up by the pickup roller 12 and then transferred to the printing unit 14, 15, 18 and 19 by the feeding roller 13. An image is developed on one side of the paper by the developer 18 and the photosensitive drum 19 of the printing unit 14, 15, 18 and 19, and the image is fixed on the paper by the fixing roller 15. Then, when the paper is ejected by the ejection roller 17, except for one end part of the paper which remains inside the apparatus, the rotation direction of the ejection roller 17 is reversed and the paper is inputted into the reversing path 20. The paper, inputted to the reversing path 20, is then supplied to the feeding roller 13 by the transfer roller 22. There, the paper is supplied to the printing unit 14, 15, 18 and 19 again and an image is developed and fixed on the other side of the paper, which is then ejected from the apparatus by the ejection roller 17.

When the duplex printing mode is set up and an amount of print data requiring one side of one piece of paper is to be outputted, only one side of each piece of paper needs to be printed on. However, the conventional printers perform single-sided printing in the same manner as duplex printing, i.e., ejecting part of the paper, inputting the partially ejected paper into the reversing path 20, and printing print data on the second side of the paper. Therefore, where single-sided printing is required, the printing operation takes an excessive amount of time. This is because, although printing may be carried out through the printing path 9 and the ejection path 16, the paper is inputted again into the reversing path 20 and passes through the printing path 9 and the ejection path 16 unnecessarily. Moreover, since the transfer roller 22, the feeding roller 13, the fixing roller 15 and the ejection roller 17 should be operated while the paper is inputted into the printer again through the reversing path 20 and passes through the printing path 9 and the ejecting path 16, power consumption is increased and the life span of the printer is shortened. These problems also occur when the last side of a last page of print materials having an odd total number of side of pages is printed.

To prevent the above and/or other problems from occurring, when single-sided printing is required, a print option setup window may be activated or the print mode may be switched into a normal printing mode by manipulating menu buttons in the main body of the printer. However, since a user has to go through several selection processes to activate the print option setup window or find a corresponding print setup menu by manipulating menu buttons in the main body of the printer, such solutions are quite troublesome.

Therefore, a method that improves a printing speed by temporarily canceling the duplex printing mode and performing printing in the normal printing mode when the duplex printing mode is set up and a single-sided printing operation or the last page of print materials whose total number of side of pages is an odd number is printed should be sought.

SUMMARY OF THE INVENTION

The present invention has been developed in order to solve the above drawbacks and/or other problems associated with the conventional arrangement.

It is, therefore, an aspect of the present invention to provide a method that can improve a printing speed by temporarily canceling a duplex printing mode and performing printing in a normal printing mode when the duplex printing mode is set up and an amount of print data requiring one side of one piece of paper or the last side of a past piece of paper of print data requiring an odd number of total sides of pieces of paper are printed, and a duplex printing controlling method thereof.

In accordance with an aspect of the present invention, the foregoing and/or other objects and advantages are substantially realized by providing a printer, including a printing unit to print print data on print medium. The printer includes a memory to temporarily store the print data supplied from a user terminal, a controller to temporarily cancel a duplex printing mode of the printer and to control the printing unit to print the print data in a normal printing mode, when the duplex printing mode is preset and a quantity of the print data temporarily stored in the memory is within a range of predetermined quantities, a printing path along which the paper is provided to the printing unit so as to have an image printed on a first side thereof, an ejecting path along which the pieces of print media, having had the image printed on the first sides thereof, are ejected from the printer in the normal printing mode, or are partially ejected from the printer in the duplex printing mode, and a reversing path to convey the print medium from the partly ejected position of the ejecting path and toward a beginning of the printing path to position the print medium to be conveyed along the printing path so as to have another image printed on a second side thereof.

In accordance with another aspect of the present invention, the foregoing and/or other objects and advantages are substantially realized by providing a method to control a duplex printing mode in a printer, comprising setting the printer in a duplex printing mode, receiving print data; temporarily storing the print data in a memory, determining a number of sides of pieces of paper required for printing based on a quantity of the print data, temporarily canceling the duplex printing mode in favor of a normal printing mode, when the quantity of the print data is a predetermined quantity, and printing the print data in the normal printing mode.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
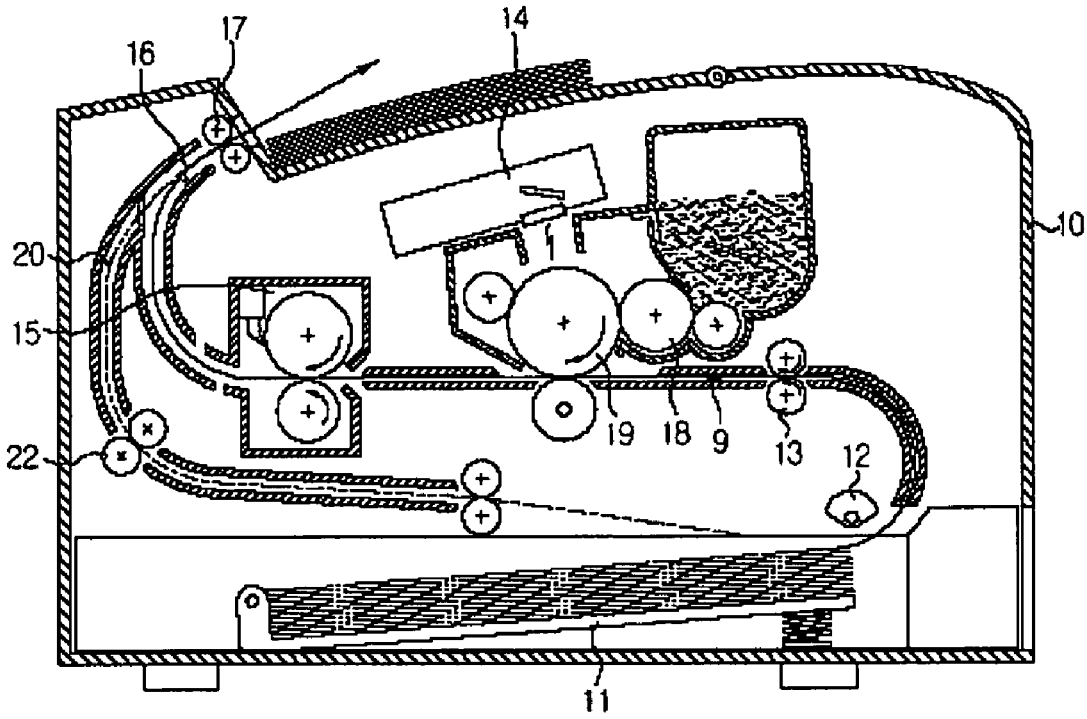
FIG. 1 (PRIOR ART)
FIG. 1 is a cross-sectional view showing a conventional laser beam printer having a duplex printing capability.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
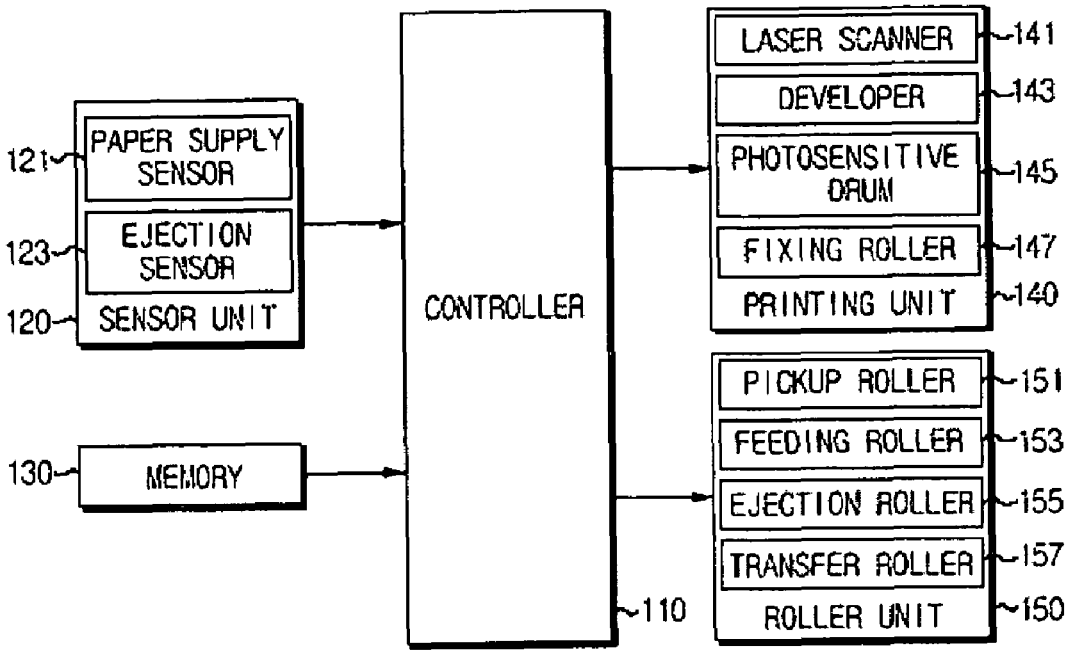
FIG. 2 is a block diagram illustrating a laser beam printer in accordance with an embodiment of the present invention.

FIG. 2 is a block diagram illustrating a laser beam printer in accordance with an embodiment of the present invention. As illustrated in the drawing, the laser beam printer includes a printing unit 140, a roller unit 150, a sensor unit 120, a memory 130 and a controller 110. FIG. 1 shows a printing path 9, along which an image is printed onto paper, an ejecting path 16 along which the printed paper is ejected from the printer, and a reversing path 20 to allow for a reversing of the paper for duplex printing, i.e., printing on both sides of the paper.

The printing unit 140 includes a laser scanner 141, a developer 143, a photosensitive drum 145, and a fixing roller 147. The laser scanner 141 scans the photosensitive drum 145 with a laser when print data is provided from a user terminal. The laser-scanned photosensitive drum 145 comes to have an electric potential. The developer 143 develops toner on the photosensitive drum 145, which transfers the developed toner onto paper. The fixing roller 147 fixes the toner transferred onto paper with heat and pressure.

The roller unit 150 includes a pickup roller 112, a feeding roller 113, an ejection roller 155, and a transfer roller 157. The pickup roller 112 picks up paper in a paper supplying cassette, and the feeding roller 113 feeds the paper picked up by the pickup roller 112 into the printing unit 140. The ejection roller 155 reverses a driving direction of the ejection roller 155 under the control of the controller 110, which will be described later, to transfer the paper toward an ejection direction or toward the beginning of the reversing path 20. The transfer roller 157 is positioned in the reversing path 20 and guides the paper to the feeding roller 113.

The sensor unit 120 includes a paper supply sensor 121 and a paper ejection sensor 123. The paper supply sensor 121 is set up proximate to the paper supply cassette and senses whether paper is picked up by the pickup roller 112. The paper ejection sensor 123 is set up proximate to the ejection roller 155 and senses whether paper is ejected and how much of a part of the paper is ejected.

The memory 130 temporarily stores print data provided from a user terminal, and determines how many sides of pieces of paper the print data will require based on the quantity of the print data stored in the memory 130. The print data stored in the memory 130 is outputted in a First-In First-Out (FIFO) method with respect to each sheet of paper, both sides of which are to be printed on during duplex printing. The sides of each one sheet of paper are printed in a Last-In First-Out (LIFO) method. In other words, when print data of a hypothetical document having pages 1 to 4, pages 1 and 2 are inputted prior to pages 3 and 4 based on the FIFO method. For each of the pages 1 and 2, during duplex printing, page 2 is printed prior to page 1 based on the LIFO method.

The controller 110 controls the printing unit 140 and the rollers based on information inputted from the sensor unit 120 and the memory 130. In the duplex printing mode, when the controller 110 determines that paper has passed through the ejection roller 155 except for the one end part of the paper based on a sensing result obtained in the ejection sensor 123, the controller 110 rotates the ejection roller 155 in a reverse direction to input the paper into the reversing path 20. In the duplex printing mode, the controller 110 determines how many sides of pieces of paper the print data will require based on the quantity of the print data stored in the memory 130. As a result of the determination, if the total number of sides of pieces of paper of the print data is one side of one piece of paper or an odd number of sides of paper with one side of one piece of paper remaining to be printed, the controller 110 temporarily cancels the duplex printing mode. In short, when the quantity of print data requires printing on one side of one piece of paper, the controller 110 temporarily cancels the duplex printing mode to prevent the ejection roller 155 from rotating in the reverse direction during the ejection of the paper and to prevent the paper from being inputted unnecessarily into the reversing path 20. When the total number of sides of sides of pieces of paper is an odd number, the controller 110 performs printing in the duplex printing mode except for when the printing is done on the last side of the last piece of paper. Then, when the last side of the last piece of paper is printed, the controller 110 cancels the duplex printing mode to prevent the paper from circulating unnecessarily through the reversing path 20.

Figure 3:
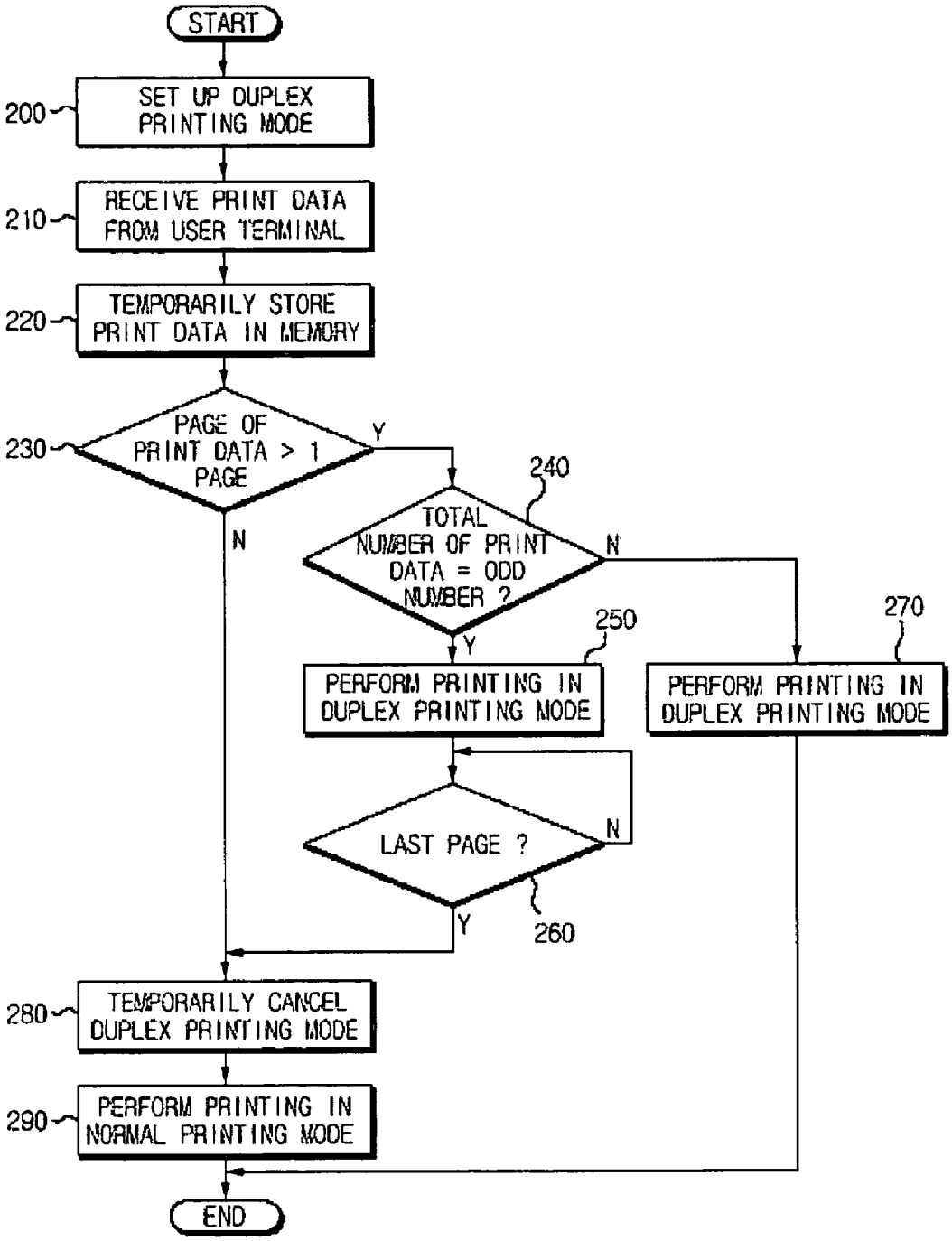
FIG. 3 is a flowchart describing a duplex printing process in a laser beam printer in accordance with another embodiment of the present invention.

A duplex printing process in the printer having the above-described structure will be described hereafter with reference to FIG. 3. First, in operation 200, a duplex printing mode is set up in a user terminal or a printer. When print data is provided from the user terminal in operation 210, the controller 110 temporarily stores the print data in the memory 130 in operation 220 and operates the printing unit 140 and the pickup roller 112 and the feeding roller 113 of and the roller unit 150. Then, the controller 110 determines in operation 230 how many sides of pieces of paper the print data requires based on the quantity of the print data stored in the memory 130.

When the quantity of print data requires more than one piece of paper, whether the number of sides of pages, required by the print data, is an odd number or an even number is determined in operation 240. If the number of sides of pieces of paper required by the print data is an even number, the controller 110 outputs the print data in the duplex printing mode in operation 270. That is, if the total number of pieces of paper required by the print data is four (4), the controller 110 provides pages 1 and 2 to the printing unit 140 first based on the FIFO method when the controller 110 prints out the print data stored in the memory 130, and the controller 110 provides page 2 prior to page 1 among pages 1 and 2 by applying the LIFO method. This way, the print data of page 2 is printed first on one side of the paper transferred to the printing unit 140. Subsequently, the controller 110 ejects the paper except for a part of the paper using the ejection roller 155 and when the controller 110 determines that a predetermined part of the paper is, the controller 110 rotates the ejection roller 155 in a reverse direction and supplies the paper to the feeding roller 113 through the reversing path 20. The print data of the page 1 is then printed on the other side of the paper supplied to the printing unit 140 through the feeding roller 113, and the paper having had both sides printed on is ejected from the printer by the ejection roller 155.

Meanwhile, when the quantity of printed data stored in the memory 130 requires one side of one piece of paper, the controller 110 temporarily cancels the duplex printing mode in the operation 270 and prints the print data in the normal printing mode in operation 290. In short, the controller 110 supplies the print data, requiring one side of one piece of paper, from the memory 130 to the printing unit 140, which prints the one side of one page print data on a sheet of paper. When the printing is completed, the controller 110 drives the ejection roller 155 and ejects the paper transferred through the ejecting path directly to the outside.

Also, when the quantity of print data stored in the memory 130 requires an odd number of sides of pieces of paper, in other words, when the total number of pieces of paper required by the print data quantity is an odd number, the controller 110 performs printing in the duplex printing mode up to the last even numbered piece of paper in operation 250 and temporarily cancels the duplex printing mode and performs the printing in the normal printing mode in operation 290 when the last side of the last piece of paper remains to be printed.

As is described above, in accordance with aspects of the present invention, a user need not change the setup of the normal printing mode of a printer by manipulating a menu of the printer or a print option setup window, because the printer temporarily cancels the duplex printing mode when print data requiring one side of one piece of paper is inputted or the total pages required by the print data is an odd number when the print is preset in the duplex printing mode. In such printing operations, each piece of paper need not be inputted into the reversing path 20 and then passed through the printing path 9 and the ejecting path 16 again. Therefore, providing users with convenience, shorten printing times, and lengthen the life spans of printers by relieving the printer from wasteful operations is possible.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A controller of an image forming apparatus to automatically switch an operational mode from a duplex mode, in which images are printed onto both sides of a piece of print medium, to a normal mode, in which an image is printed onto one side of the piece of print medium, when the controller determines whether or not print data requires a single page based on whether a quantity of the print data temporarily stored in a memory is a predetermined quantity, to print the print data in the normal printing mode if the print data requires a single page, and to automatically convert the duplex printing mode into the normal printing mode to print the last page of the print data if the print data requires odd-numbered pages exceeding a single page, wherein the controller provides print data on first and second pages in advance of third and fourth pages from among the first to fourth pages stored in the memory to a printing unit based on a First-In First-Out (FIFO) method, and in the case of printing first and second pages on each sides of a paper, provides the second page to the printing unit first based on a Last-In First-Out (LIFO) method, so that the second page is printed in advance of the first page.

2. A printer, including a printing unit to print data on print medium, the printer comprising:

a memory to temporarily store the print data supplied from a user terminal;

a controller to temporarily cancel a duplex printing mode of the printer and to control the printing unit to print the print data in a normal printing mode, when the duplex printing mode is preset and a quantity of the print data temporarily stored in the memory is predetermined quantities;

a printing path along which the print medium is provided to the printing unit so as to have an image printed on a first side thereof;

an ejecting path along which the pieces of print media, having had the image printed on the first sides thereof, are ejected from the printer in the normal printing mode, or are partially ejected from the printer in the duplex printing mode; and a reversing path to convey the print medium from the partly ejected position of the ejecting path and toward a beginning of the printing path to position the print medium to be conveyed along the printing path so as to have another image printed on a second side thereof, wherein the controller determines whether or not the print data requires a single page based on the quantity of the print data temporarily stored in the memory, and if the print data requires a single page, the print data is printed in the normal printing mode, and if the print data requires odd-numbered pages exceeding a single page, the last page of the print data is printed in the normal printing mode, wherein the controller provides print data on first and second pages in advance of third and fourth pages from among the first to fourth pages stored in the memory to the printing unit based on a First-In First-Out (FIFO) method, and in the case of printing first and second pages on each sides of a paper, providing the second page to the printing unit first based on a Last-In First-Out (LIFO) method, so that the second page is printed in advance of the first page.

3. The printer as claimed in claim 2, wherein the controller controls the printing unit to print the print data in the normal printing mode when a total number of sides of pieces of print media required for printing by the quantity of the print data is an odd number and a last page of the print data remains to be printed.

4. The printer as claimed in claim 2, wherein the controller controls the printing unit to print the print data in the normal printing mode when the quantity of the print data requires one side of a piece of print medium.

5. A method to control a duplex printing mode in a printer, comprising:

setting the printer in a duplex printing mode;

receiving print data;

temporarily storing the print data in a memory;

determining a number of sides of pieces of print media required for printing based on a quantity of the print data stored in memory;

providing print data on first and second pages in advance of third and fourth pages from among the first to fourth pages stored in the memory to a printing unit based on a First-In First Out (FIFO) method, and in the case of printing first and second pages on each sides of a paper, providing the second page to the printing unit first based on a Last-In First-Out (LIFO) method, so that the second page is printed in advance of the first page temporarily canceling the duplex printing mode in favor of a normal printing mode, when the quantity of the print data stored in memory is a predetermined quantity; and printing, by the printing unit, the print data in the normal printing mode, wherein in the temporarily canceling of the duplex printing mode in favor of the normal printing mode, it is determined whether or not the print data requires a single page based on the quantity of the print data temporarily stored in the memory, and if the print data requires a single page, the print data is printed in the normal printing mode, and if the print data requires odd-numbered pages exceeding a single page, the last page of the print data is printed in the normal printing mode.

6. The method as recited in claim 5, wherein the predetermined quantity of print data is reached when the quantity of the print data requires an odd number of sides of pieces of print media on which the print data is to be printed and a last page of the print data remains to be printed.

7. The method as recited in claim 5, wherein the predetermined quantity of print data is reached when the quantity of the print data requires one side of one of the pieces of print medium on which the print data is to be printed.

8. An image forming apparatus to operate in a normal mode, in which images stored as data in a memory are printed on single sides of pieces of print media, and in a duplex mode, in which the images stored as data in the memory are printed on both sides of the pieces of print media, the apparatus comprising:

a printing path along which the pieces of print media are conveyed so as to have the images printed on first sides thereof;

an ejecting path along which the pieces of print media, having had the images printed on the first sides thereof, are ejected from the apparatus in the normal printing mode, or are partially ejected from the apparatus in the duplex printing mode;

a reversing path to convey the partially ejected pieces of print media to a beginning of the printing path along which the pieces of print media are conveyed so as to have the images printed on second sides thereof; and a controller to determined whether or not print data requires a single page based on whether a quantity of the print data temporarily stored in a memory is a predetermined quality, to print the print data in the normal printing mode if the print data requires a single page, and to automatically convert the duplex printing mode into the normal printing mode to print the last page of the print data if the print data requires odd-numbered pages exceeding a single page, wherein the controller provides print data on first and second pages in advance of third and fourth pages from among the first to fourth pages stored in the memory to a printing unit based on a First-In First-Out (FIFO) method, and in the case of printing first and second pages on each sides of a paper, provides the second page to the printing unit first based on a Last-In First-Out (LIFO) method, so that the second page is printed in advance of the first page.

9. The apparatus according to claim 8, further comprising a printing unit to print the images.

10. The apparatus according to claim 9, wherein the printing unit comprises:

a photosensitive drum to receive an electric potential;

a laser scanner to scan the photosensitive drum with a laser when print data is provided from a user terminal so as to generate the electric potential in the photosensitive drum;

a developer to develop toner on the photosensitive drum; and a fixing roller to fix the toner onto the pieces of print media onto which the toner is applied.

11. The apparatus according to claim 8, further comprising:

a pickup roller to pick the pieces of print media up from a stack of print media;

a feed roller to feed the picked up pieces of print media into and through the apparatus;

an ejection roller to eject the pieces of print media from the apparatus wholly and/or partly; and a transfer roller to convey the pieces of print media along the reversing path.

12. The apparatus according to claim 11, further comprising a sensor unit to sense positions of pieces of print media in the apparatus.

13. The apparatus according to claim 8, further comprising a memory unit to store print data in the apparatus and to determine how many sides of pieces of print media will be required for printing operations corresponding to the print data.

14. An image forming apparatus to operate in a normal mode, in which images stored as data in a memory are printed on single sides of pieces of print media, and in a duplex mode, in which the images stored as data in the memory are printed on both sides of the pieces of print media, the apparatus comprising:

a printing path along which the pieces of print media are conveyed so as to have the images printed on first sides thereof;

an ejecting path along which the pieces of print media, having had the images printed on the first sides thereof, are elected from the apparatus in the normal printing mode, or are partially ejected from the apparatus in the duplex printing mode;

a reversing path to convey the partially ejected pieces of print media to a beginning of the printing path along which the pieces of print media are conveyed so as to have the images printed on second sides thereof; and a controller to determined whether or not print data requires a single page based on whether a quantity of the print data temporarily stored in the memory is a predetermined quantity, to print the print data in the normal printing mode if the print data requires a single page, and to automatically convert the duplex printing mode into the normal printing mode to print the last page of the print data if the print data requires odd-numbered pages exceeding a single page, wherein, during the duplex printing, the pages of print data are printed in order starting at a first piece of print medium thereof, and sides of each of the pages of print data are printed in reverse order.

15. A method of controlling an image forming apparatus to operate in a normal mode, in which images stored as data in a memory are printed on single sides of pieces of print media, and in a duplex mode, in which the images stored as data in the memory are printed on both sides of the pieces of print media, the method comprising:

conveying the pieces of print media so as to have the images printed on first sides thereof;

ejecting the pieces of print media, having had the images printed on the first sides thereof, from the apparatus in the normal printing mode, or partially ejecting the pieces of print media from the apparatus in the duplex printing mode;

conveying the partially ejected pieces of print media so as to have the images printed on second sides thereof; and determining whether or not print data requires a single page based on whether a quantity of the print data temporarily stored in the memory is a predetermined quantity, providing print data on first and second pages in advance of third and fourth pages from among the first to fourth pages stored in the memory to a printing unit based on a First-In First-Out (FIFO) method, and in the case of printing first and second pages on each sides of a paper, providing the second page to the printing unit first based on a Last-In First-Out (LIFO) method, so that the second page is printed in advance of the first page, printing the print data in the normal printing mode if the print data requires a single page, and automatically converting the duplex printing mode into the normal printing mode to print the last page of the print data if the print data requires odd-numbered pages exceeding a single page.

* * * * *

UNITED STATES PATENT AND TRADEMARK OFFICE

CERTIFICATE OF CORRECTION

PATENT NO. : 7,912,396 B2
APPLICATION NO. : 11/384384
DATED : March 22, 2011
INVENTOR(S) : Park It is certified that error appears in the above-identified patent and that said Letters Patent is hereby corrected as shown below:

Title Page Column 2, Line 5 delete “corrresponding” and insert -- corresponding --, therefor.

Title Page Column 2, Line 1 after “to print” insert -- the --.

Column 6, Line 36 in Claim 2, after “is” insert -- a --.

Column 6, Line 37 in Claim 2, delete “quantities;” and insert -- quantity; --, therefor.

Column 7, Line 22 in Claim 5, delete “First Out” and insert -- First-Out --, therefor.

Column 7, Line 26 in Claim 5, delete “page” and insert -- page; --, therefor.

Column 8, Line 4 in Claim 8, delete “quality,” and insert -- quantity, --, therefor.

Signed and Sealed this
Fourteenth Day of June, 2011

David J. Kappos

David J. Kappos
*Director of the United States Patent and Trademark Office*